US006663729B2

(12) United States Patent
Jin et al.

(10) Patent No.: US 6,663,729 B2
(45) Date of Patent: Dec. 16, 2003

(54) PRODUCTION OF ALUMINUM ALLOY FOILS HAVING HIGH STRENGTH AND GOOD ROLLABILITY

(75) Inventors: Iljoon Jin, Kingston (CA); Kevin Gatenby, Kingston (CA); Christopher Gabryel, Kingston (CA); Toshiya Anami, Fuji (JP); Takahiko Watai, Fujinomiya (JP); Ichiro Okamoto, Komaki (JP)

(73) Assignee: Alcan International Limited, Montreal (CA)

( * ) Notice: Subject to any disclaimer, the term of this patent is extended or adjusted under 35 U.S.C. 154(b) by 30 days.

(21) Appl. No.: 09/782,796

(22) Filed: Feb. 13, 2001

(65) Prior Publication Data

US 2002/0153068 A1 Oct. 24, 2002

(51) Int. Cl.[7] ..... C22F 1/04

(52) U.S. Cl. ..... 148/551; 148/692; 148/696; 164/463

(58) Field of Search ..... 148/551, 696, 148/692, 415; 164/463, 476, 477

(56) References Cited

U.S. PATENT DOCUMENTS 4,614,224 A * 9/1986 Jeffrey et al. ..... 164/476
5,681,405 A * 10/1997 Newton et al. ..... 148/551
5,725,695 A 3/1998 Ward et al. ..... 148/552

FOREIGN PATENT DOCUMENTS

| | | |
|---|---|---|
| EP | 0064468 | 11/1982 |
| FR | 2763602 | 11/1998 |
| GB | 1524355 | 9/1978 |
| JP | 1034548 | 2/1989 |
| JP | 6434548 | 2/1989 |
| JP | 6101003 | 4/1994 |
| JP | 6101004 | 4/1994 |
| WO | WO 98/45492 | 10/1998 |
| WO | 9923269 | 5/1999 |

* cited by examiner

*Primary Examiner*—George Wyszomierski
*Assistant Examiner*—Janelle Combs Morillo
(74) *Attorney, Agent, or Firm*—Cooper & Dunham LLP

(57) ABSTRACT

An aluminum alloy foil is formed from an alloy containing about 1.2 to 1.7% by weight Fe and about 0.35 to 0.80% by weight Si, with the balance aluminum and incidental impurities. The alloy is continuously strip cast to form a strip having a thickness less than about 25 mm, which is then cold rolled to interanneal gauge and interannealed at a temperature of at least 400° C. The interannealed strip is cold rolled and further annealed to form the final foil product, having excellent rollability combined with high strength of the final foil.

10 Claims, 2 Drawing Sheets

Cast No.3

Cast No.4

Cast No.1

PRODUCTION OF ALUMINUM ALLOY FOILS HAVING HIGH STRENGTH AND GOOD ROLLABILITY

BACKGROUND OF THE INVENTION

This invention relates to the production of aluminum alloy foil products. Specifically, it relates to a process for manufacturing an aluminum alloy foil using a continuous strip casting process in which the material has excellent rollability in the final rolling step and good strength of final foil product.

Thin gauge foils are generally prepared by casting an ingot of an aluminum alloy such as AA8021 in a process known as DC or direct chill casting. The ingots are generally heated to a high temperature, hot rolled to a re-roll gauge thickness of between 1 and 10 mm, then cold rolled to a "foil-stock" gauge typically 0.2 to 0.4 mm thick. The strip is often subjected to an interanneal step during the cold rolling process. The "foil-stock" is then subject to further cold rolling operations, often using double rolling techniques to produce a final foil thickness of about 5 to 150 microns.

There is a cost advantage to using continuous strip casting as the starting point in manufacture of such foils since homogenization prior to hot rolling is not required, and the amount of hot reduction to form re-roll gauges is greatly reduced. Where high volume continuous casting is required, twin belt casting is the preferred method of continuous casting. However, continuous strip casting processes apply different cooling conditions during solidification from those in DC casting, and there is an absence of a high temperature homogenization step prior to hot rolling. Consequently when continuous strip casting processes are used with alloys normally prepared by DC casting and homogenization, this results in the formation of different intermetallic species in the cast product which cause surface defects, known as "fir tree effect", in the final foil stock product. In continuous strip casting, the cooling rate of the strip during casting is generally higher (in some cases much higher) than the cooling rate in large DC ingots. Thus, such alloys processed in a continuous strip casting process also result in foil stock which has a higher supersaturation of solute elements, and therefore has undesirable hardening and softening properties, resulting in difficulties in rolling the foil stock to the final gauge thickness.

There is a particular interest in being able to produce aluminum foils from AA8021-type alloys by continuous strip casting. An AA8021-type alloy has the nominal composition of less than 0.2% by weight silicon and 1.2 to 1.7% by weight iron, with the balance aluminum and incidental impurities. This alloy is widely used, e.g. in Japan, in the production of foil, where it is normally cast by direct chill casting. When the same AA8021 alloy is cast on a continuous strip caster, the resulting strip does not have the same microstructure as that obtained by direct chill casting. For instance, belt casting creates cooling rates during solidification much higher than in DC casting and this generates a wide variety of intermetallic sizes and concentrations that negatively affect microstructure control. Therefore, the final anneal cannot produce the desired structure for a foil.

It is known to produce high strength aluminum foil by continuous strip casting an AA1200-type alloy strengthened by the addition of other strengthening alloying elements, such as Mn, Cu and Si. Such an alloy is easily castable on a continuous strip caster and the final product has excellent strength. However, because of the added strengthening solute elements, there is a high work hardening rate of the material during cold rolling. Thus, it is difficult to roll this material to final thin gauge.

A twin roll casting process for producing high strength aluminum foil is described in Furukawa Alum, Japanese Patent JPO1-034548. That process used an aluminum alloy containing, in percentages by weight, 0.8 to 2% Fe, 0.1 to 1% Si, 0.01 to 0.5% Cu, 0.01 to 0.5% Mg and 0.01 to 1% Mn. Ti and B were also included at grain refining levels. The alloy was twin roll cast to a thickness of 0.5 to 3 mm and rolled to foil. A heat treatment at 200 to 450° C. was also included.

Ward et al. U.S. Pat. No. 5,725,695 utilized an AA8111 alloy (containing 0.30 to 1.0% by weight Si and 0.40 to 1.0% by weight Fe) which was processed via twin roll casting, cold rolling with interanneal to a maximum of 441° C. and final anneal. The alloy used contained silicon in an amount equal to or higher than the amount of iron.

A further continuous strip casting technique using Al—Fe—Si type aluminum alloy is described in Katano et al. WO 99/23269. The continuous cast material was interannealed in a two step process using two different temperature ranges.

Another procedure for producing high strength foil material based on Al—Fe—Si alloy is described in Furukawa JPO6-101004. In this procedure the alloy was strip cast to a preferred thickness of 5 to 10 mm followed by interanneal, cold rolling and final anneal.

It is an object of the present invention to produce, using continuous strip casting, an aluminum foil having a low work hardening rate and hence good rollability, while providing high strength in the final foil product.

It is a further object of the present invention to produce an aluminum foil having a low work hardening rate and hence good rollability, and high strength in the final foil product by using a high productivity casting method.

SUMMARY OF THE INVENTION

In accordance with the present invention, the problem of producing a quality aluminum alloy foil using a continuous strip caster has been solved by way of a new alloy composition and a new processing route. Thus, the alloy that is used is one containing 1.2 to 1.7 wt % Fe and 0.35 to 0.8 wt % Si, with the balance aluminum and incidental impurities. The above alloy is then cast in a continuous strip caster to a strip thickness of less than about 25 mm, preferably about 5 to 25 mm, followed by cold rolling to interanneal gauge. The interannealing is carried out at a temperature of at least 400° C., followed by cold rolling to final gauge and final anneal.

The interanneal is preferably carried out at a temperature of about 400 to 520° C. for about 1 to 8 hours. The final anneal is preferably at a temperature of about 250 to 400° C. for about 1 to 12 hours and the continuous strip casting is preferably conducted on a belt caster.

In the above procedure, the continuously cast strip is optionally hot rolled to a re-roll gauge (typically 1 to 5 mm)

before cold rolling to the interanneal gauge. The cold rolling reduction prior to interanneal is typically at least 40%. For best results both the heating and cooling rates in the interanneal stage are maintained within the range of about 20 to 60° C./h.

The use of the above alloy composition has substantially eliminated the "fir tree effect". The absence of this fir tree effect means that the surface quality of the final foil is improved and the pin hole frequency in the final foil is reduced.

It has also surprisingly been found that with the above combination of alloy composition and processing route, the work hardening behaviour of the alloy is similar to that of fully homogenized direct chill cast AA8021. It is believed that this surprising effect is a result of the accelerated decomposition of the supersaturated alloying elements in the matrix alloy during the interanneal process.

Thus, the invention provides the structure and properties of foil material that are essential for making a good quality, high strength foil, namely:

(a) a uniform intermetallic phase distribution in the as-cast state (no fir tree effect);

(b) low work hardening rate and hence good rollability (UTS after a cold reduction of 90% is below 190 MPa); and (c) high strength in the final product (UTS at 0 temper—after final anneal—is greater than 90 MPa).

In the above alloy, the Fe is the primary strengthening element and forms Fe containing intermetallic particles during casting (which are broken into smaller particles during subsequent rolling stages). These particles contribute to strengthening by particle strengthening and by stimulating grain nucleation in the final anneal stage, resulting in a fine grain structure in the final product. If Fe is less than 1.2 wt %, this strengthening is insufficient, and if Fe is greater than 1.7 wt %, large primary intermetallic particles form during casting which are harmful for rolling and the quality of the foil products.

In the above alloy, the Si retards formation of non-equilibrium intermetallic compounds during casting, which therefore improves the uniformity of the cast structure (eliminates "fir-tree" effect).It also improves rollability. If Si is lower than 0.35 wt %, it is insufficient to promote the uniformity of the cast structure, whereas when Si exceeds 0.8 wt %, it can increase the work hardening rate, causing adverse effects on rolling.

The continuous casting step is preferably conducted in a twin belt caster. The final properties of the strip are dependent on achieving a fine grain size, and twin-roll casting is not able to achieve as fine a grain size as belt casting when the alloy and subsequent processing of the present invention are used. Furthermore the belt-caster is capable of substantially higher production rates than a twin-roll caster.

Belt casting is a form of continuous strip casting carried out between moving flexible and cooled belts. Although the belts may exert a force on the strip to ensure adequate cooling, preferably the force is insufficient to compress the strip while it is solidifying. Typically a belt caster will cast strips less than about 25 mm thick and preferably greater than about 5 mm thick. The cooling rate for casting alloys of the present invention generally lies between about 20 and 300° C./sec.

EXAMPLE 1

A series of test were carried out with the six alloys listed in Table 1 below:

TABLE 1

| Cast No. | Fe | Si |
|---|---|---|
| 1 | 1.54 | 0.47 |
| 2 | 1.25 | 0.11 |
| 3 | 1.52 | 0.11 |
| 4 | 1.23 | 0.29 |
| 5 | 0.43 | 0.22 |
| 6 | 1.43 | 0.42 |

The alloys in Table 1 were cast on a laboratory twin belt caster to a thickness of about 7.3 mm. The belts used were textured steel belts operated to give heat fluxes 1.5 to 2.5 $MW/M^2$. This was equivalent to a cooling rate of between 150 and 275° C./s averaged through the thickness of the strip.

Figure 1:
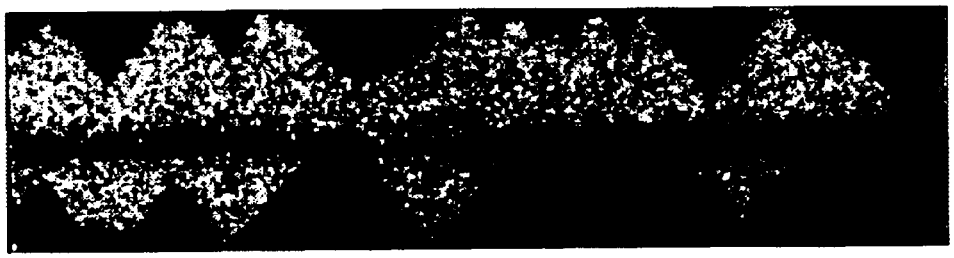
FIG. 1 shows cast structures in transverse cross section of the as cast strip with varying silicon contents.
Figure 1:
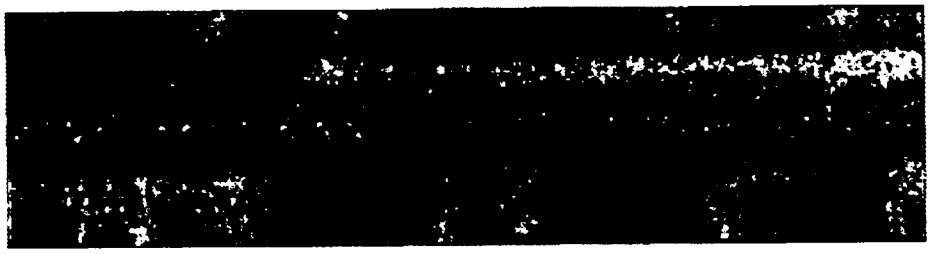
Figure 1:
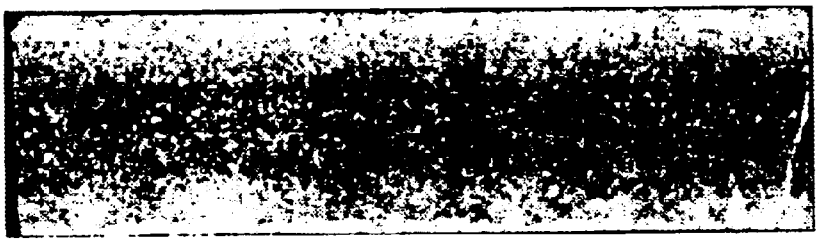

The as-cast strip samples were metallographically prepared to examine the cast structures in the transverse cross section. FIG. 1 shows the anodized surfaces of the cross sections for samples from Casts 1, 3 and 4. This reveals the extent of the intermetallic particle non-uniformity. It is apparent that the intermetallic phase uniformity is clearly related to the Si content of the alloy. From this examination, it can be seen that, when the high Fe alloys (with Fe in the inventive range) are cast on a belt caster, a Si level of 0.29 wt % (below the inventive range) results in a non-uniform cast structure. All six alloys were examined by the same method and only alloys 1, 5 and 6 had a uniform microstructure (absence of fir-tree effect). Alloys 2,3 and 4 were structurally unsound (fir tree effect). Alloys 1, 5 and 6 were further processed as described in Table 2.

Figure 2:
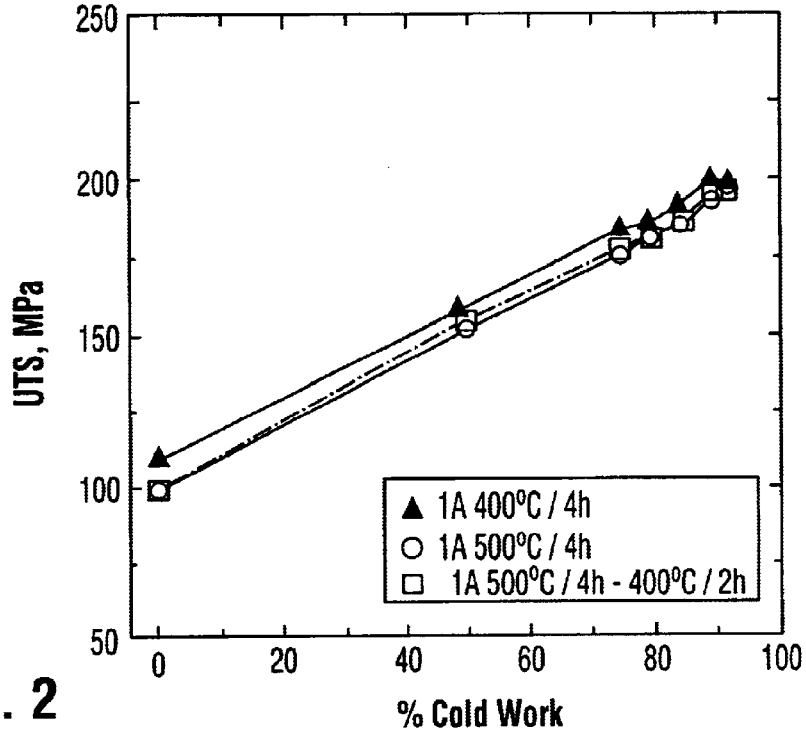
FIG. 2 is a graph relating UTS to the percent cold work for different interannealing conditions.
Figure 3:
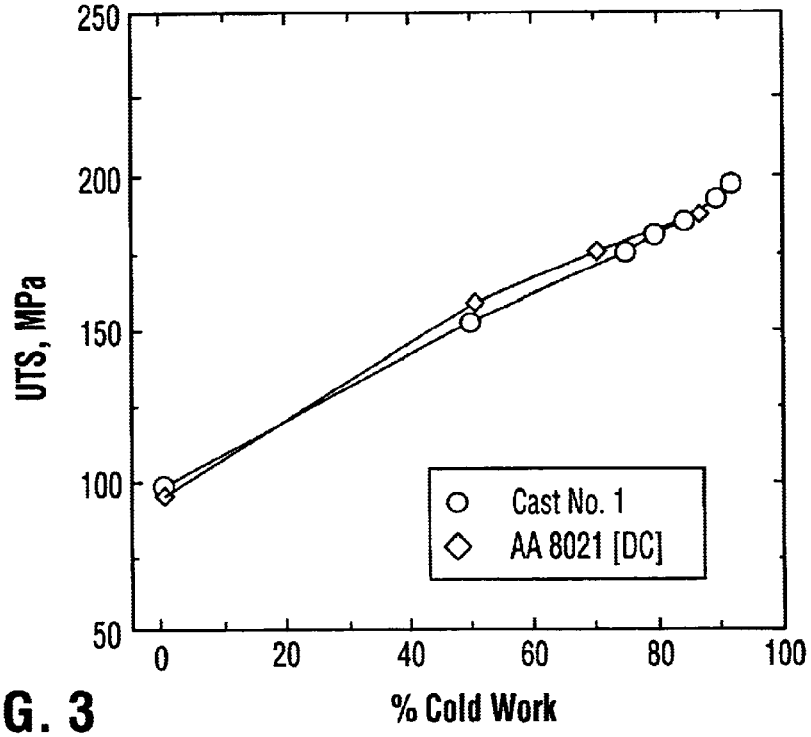
FIG. 3 is a graph relating UTS to percent cold work for the product of the invention and direct chill cast AA8021.

The alloy strip from Cast No. 1 was processed using a number of different processing routes, and the work hardening behaviours of the resulting samples were examined. FIG. 2 is a plot of UTS v. % cold work showing the work hardening behaviours of the samples that were processed by 3 different interannealing conditions. One sample was interannealed at 400° C. for 4 hours, while a second sample was interannealed at 500° C. for 4 hours. A third sample was interannealed at 500° C. for 4 hours followed by 400° C. for 2 hours. FIG. 3 is a plot of UTS v. % cold work giving a comparison of the work hardening behaviours of the belt cast alloy interannealed at 50° C. and DC cast AA8021 alloy. From these results it can be seen that the belt cast material according to this invention has essentially the same work hardening behaviour as direct chill cast AA8021.

In order to test if the material meets the target strength of the end product (a UTS of 90 MPa or higher at 0 temper), both belt cast (Cast No. 1, 5 and 6) and DC cast materials were processed to the final gauge and 0 temper annealed, and the rolled samples before and after the final anneal were tensile tested. The processing conditions and results obtained are shown in Table 2.

TABLE 2

| Alloy | Sheet Thickness before Interanneal (mm) | Interanneal Heating Rate (° C./h) | Interanneal Temp.* (° C.) | Interanneal Cooling Rate (° C./h) | Foil Thickness (μm) | Strength after 90% reduction (MPa) | Strength 0 Temper Strength (MPa) |
|---|---|---|---|---|---|---|---|
| 1 | 4.0 | 25 | 500 | 25 | 500 | 185 | 106 |
| 1 | 0.5 | 25 | 500 | 25 | 55 | 187 | 107 |
| 1 | 0.5 | 100 | 400 | 3400 | 59 | 194 | 106 |
| DC AA8021 | 0.5 | 100 | 400 | 3400 | 56 | 187 | 92 |
| 5 | 4.0 | 25 | 500 | 25 | 500 | 175 | 87 |
| 6 | 4.0 | 25 | 350 | 25 | 500 | 206 | 120 |

*Soaking time = 4 hours

When Alloy 1 was processed with the preferred controlled interanneal process of the present invention (a heat up and cool down rate of 25 C./h) the sheet had a uniform microstructure (no fir tree) and the strength at 90% reduction and after final anneal (O temper) were comparable to DC cast properties (for AA8021 in the above table). However when the same alloy, belt cast, but processed with faster heat up and cool down on interanneal than the preferred range, the strength after 90% reduction became higher than that of the same alloy processed by the preferred route.

Alloy 5 had a lower Fe and Si than the inventive range, and when processed by belt casting and the preferred interanneal process gave too low a strength in the 0 temper state (after final anneal).

Alloy 6 had a composition within the inventive range and was processed in accordance with the conditions of the present invention except that the interanneal temperature was below the preferred range. This led to a material with excessively high strength after 90% cold reduction.

Table 2 clearly shows that the material of the present invention has comparable properties to the conventional high strength DC material, and meets the target strength at 90% cold reduction and 0 temper.

What is claimed is:

1. A process for producing an aluminum foil product by continuous strip casting in which the product exhibits excellent rollability combined with high strength of final foil product comprising the steps of:

(a) providing an aluminum alloy containing 1.2 to 1.7% by weight Fe and 0.35 to 0.80% by weight Si, with the balance aluminum and incidental impurities, (b) continuous strip casting the alloy on a belt caster to form a cast strip having an as-cast thickness of less than about 5 to 25 mm, (c) cold rolling the cast strip to interanneal gauge, (d) interannealing the strip at a temperature of at least 400° C., (e) cold rolling the interanneal strip to final gauge, and (f) subjecting the final gauge strip to a final anneal.

2. The process according to claim 1 wherein the as-cast strip is hot rolled prior to cold rolling.

3. The process according to claim 1 wherein the interanneal is carried out at a temperature of 520° C. or less.

4. The process according to claim 3 wherein the interanneal is conducted at a temperature of about 400 to 520° C. for about 1 to 8 hours.

5. The process according to claim 1 wherein the final anneal is conducted at a temperature of about 250 to 400° C.

6. The process according to claim 5 wherein the final anneal is conducted at a temperature of about 250 to 400° C. for about 1 to 12 hours.

7. The process according to claim 1 wherein the cast strip is heasted to annealing temperature at a heating rate of about 20 to 60° C./hr.

8. The process according to claim 1 wherein the strip after interannealing and a cold reduction or 90% has an ultimate tensile strength (UTS) of below 190 MN and the foil after final anneal has a UTS at 0 temper of greater than 90MPa.

9. The process according to claim 7 wherein the cast strip is cooled after annealing at a cooling rate of about 20 to 60° C./hr.

10. A process for producing an aluminum foil product by continuous strip casting in which the product exhibits excellent rollability combined with high strength of final foil product comprising the steps of:

(a) providing an aluminum alloy consisting essentially of 1.2 to 1.7% by weight Fe and 0.35 to 0.80% by weight Si, with the balance aluminum and incidental impurities, (b) continuous strip casting the alloy on a belt caster to form a cast strip having an as-cast thickness of about 5 to 25 mm, (c) cold rolling the cast strip to interanneal gauge, (d) interannealing the strip, said interannealing consisting of annealing at a temperature of at least 400° C., (e) cold rolling the interanneal strip to final gauge, and (f) subjecting the final gauge strip to a final anneal, wherein step (d) is performed such that the strip after interannealing and a cold reduction of 90% has an ultimate tensile strength (UTS) of below 190 MPa, and wherein the strip after step (f) has a UTS of 90 MPa or higher at 0 temper.

* * * * *

UNITED STATES PATENT AND TRADEMARK OFFICE

CERTIFICATE OF CORRECTION

PATENT NO. : 6,663,729 B2
DATED : December 16, 2003
INVENTOR(S) : Iijoon Jin et al.

It is certified that error appears in the above-identified patent and that said Letters Patent is hereby corrected as shown below:

Column 5,
Line 50, delete "less than"

Signed and Sealed this

Fourth Day of January, 2005

JON W. DUDAS
*Director of the United States Patent and Trademark Office*